US005433556A

United States Patent [19]

Freeman, III

[11] Patent Number: 5,433,556

[45] Date of Patent: Jul. 18, 1995

[54] SYSTEM FOR UNDERPINNING A BUILDING

[75] Inventor: Thomas R. Freeman, III, St. Charles, Mo.

[73] Assignee: Freeman Piering Systems, Inc., St. Louis, Mo.

[21] Appl. No.: 195,293

[22] Filed: Feb. 14, 1994

Related U.S. Application Data

[62] Division of Ser. No. 44,162, Apr. 8, 1993, Pat. No. 5,336,021, which is a division of Ser. No. 871,122, Apr. 20, 1992, Pat. No. 5,217,325, which is a division of Ser. No. 713,265, Jun. 11, 1991, Pat. No. 5,116,355.

[51] Int. Cl.[6] ..... E02D 5/00

[52] U.S. Cl. ..... 405/229; 52/737.2; 405/230

[58] Field of Search ..... 405/230, 229, 232; 52/292, 293

[56] References Cited

U.S. PATENT DOCUMENTS

| | | | |
|---|---|---|---|
| 3,902,326 | 9/1975 | Langenbach | 405/230 X |
| 4,634,319 | 1/1987 | May | 405/230 |
| 4,765,777 | 8/1988 | Gregory | 405/230 |
| 4,800,700 | 1/1989 | May | 405/230 X |
| 5,120,163 | 6/1992 | Holdeman et al. | 405/230 |

*Primary Examiner*—Dennis L. Taylor
*Attorney, Agent, or Firm*—Paul M. Denk

[57] ABSTRACT

A pier driving assembly is disclosed which supports the foundation under compression forces. The pier driving assembly includes a pier driving bracket which drives the pier pipes into the ground, a pier head which is placed on the pier pipe after the pipe has been driven to bedrock and the pier driving bracket assembly has been removed, and a loading bracket which gives the final lift to the foundation to make it level. When complete, all that is left in the ground is the pier and the pier head. The pier driving bracket and loading bracket are removed when their use is completed. This assembly allows for easy access to the pier should the building settle again. A modified pier driving assembly includes a pier driving unit, incorporating a pair of hydraulic jacking cylinders, for stabilization of the unit into position when located within the foundation excavation, the unit having a pair of hydraulic driving cylinders, cooperating with a guide block, for driving pier pipe segments into the ground; the unit being removed, and replaced by a pier head, incorporating a pair of lateral brackets, for supporting a pair of hydraulic jacking cylinders, for stabilizing or raising of the foundatin wall and footing, when energized, and providing for the locating of a bolt means therein, which when tightened against a bearing plate arranged at the underside of the footing, supports the building foundation and footing thereon, allowing for the removal of the temporarily emplaced hydraulic jacking cylinders. When accomplished, the excavation can be refilled, concealing the supporting bolt means, pipe segments, bearing plate, all underground, and stabilizing the building wall and integral footing.

1 Claim, 4 Drawing Sheets

SYSTEM FOR UNDERPINNING A BUILDING

This is a divisional application of the same inventor filed in the United States Patent Office on Apr. 8, 1993, under Ser. No. 08/044,162, now U.S. Pat. No. 5,336,021 which is a divisional application of the same inventor filed in the United States Patent Office on Apr. 20, 1992, under Ser. No. 07/871,122, now U.S. Pat. No. 5,217,325 which is a divisional application of the same inventor filed in the United States Patent Office on Jun. 11, 1991, under Ser. No. 07/713,265 now U.S. Pat. No. 5,116,35.

BACKGROUND OF THE INVENTION

This invention relates to the underpinning of buildings which have settled, and, in particular, to pier driving brackets and pier support brackets which are used in underpinning the building.

Most residential and low rise commercial buildings do not have foundations which extend to bedrock. Rather, they have a footing on which the foundation wall sits. The footing is generally wider than the foundation wall, so as to distribute the weight of the building over a greater area. The foundation thus rests on soil which may shift. This in turn will cause the foundation to settle. Because the foundation generally does not settle evenly, cracks will undesirably develop in the foundation wall.

The partially settled foundation is generally repaired by driving piers down to the bedrock beneath the footing and jacking up the settled portion of the foundation so that it is even with the rest of foundation.

Various systems have been developed over the years to provide a method of supporting structures on pipes driven into the ground. What can be seen as a deficiency common to many of these systems is the fact that they use the same bracket to both drive the pier pipe into the ground and later support the building on top of the pier pipe. Elaborate bracket configurations are used at the top of the pier in many of these systems to accomplish this. Obviously, elaborate bracket arrangements are more complex of usage and application, and excessively costly to manufacture and acquire.

In some prior art underpinning assemblies, the pier is parallel to and adjacent the foundation, rather than beneath it. In these underpinning assemblies, one or two screws, pins or the like are driven through a pier driving/foundation supporting bracket and into the foundation wall to hold the foundation in place relative to the pier. This creates a great shearing force on the screws, which, after a period of time, could cause the screws to fail. It also mars the foundation walls.

Some examples of the types of prior art piering assemblies that are known in the art are as follows. For example, the patent to Gregory, U.S. Pat. No. 4,765,777 shows an apparatus and method for raising and supporting a building. As can be seen, and particularly in its FIG. 2, the apparatus includes a lifting arm means, that incorporates a retaining member which engages the lifting arm means, and which connects with the outer wall of the foundation or slab, as through a bolt configuration. In addition, pipe means extend adjacent the retaining member, driving means engage the upper portion of the pipe means, and this driving means is the disclosed clamp. A ram connects between the driving means of the lifting arm means, through various plates, and these rams are actuated for driving the pipe means into the ground until they encounter resistance. While this prior art patent discloses means for lifting of a foundation, or slab, it does so in a manner that is fabricated differently from the assembly of the current invention.

The patent to Rippe, U.S. Pat. No. 4,708,528, also discloses a process and apparatus for stabilizing foundations. As can be seen, and particularly upon reviewing its specification, it relates to the usage of a form of bracket that includes a sleeve which is held by a rod to the wall of a foundation to be stabilized, with the pier sections configured to fit within and slide easily through the sleeve of the bracket when driven by the jacking apparatus. The current invention operates differently, with discrete structure, for achieving a driving of pier sections to bedrock.

The patent to Langenbach, Jr., U.S. Pat. No. 4,678,373, relates to a specific type of shoring system, and includes a series of piles, with the piles incorporating a plurality of footing structures, in order to provide supplemental support for the pile structures in further supporting the foundation through engagement of these footing structures with the soil, particularly when contact with bedrock may not be attained. The current invention does not utilize any type of footing structure, between pile sections, in its assembly.

Another patent to Langenbach, Jr., U.S. Pat. No. 3,902,326, shows a device in the form of a foundation engaging means, incorporating a type of C-shaped bracket, which is used in combination with a particularly styled apparatus, that includes a power operated means for driving support means or pipe sections into the ground and to bedrock. Obviously, in this device, the hydraulic means, once it has been employed, is removable, but this is certainly true of almost all of the prior art devices known in this particular field. This patented device defines means for engaging the foundation having further means for receiving and guiding its support means, comprising various pipe sections, as they are driven into the ground. Furthermore, the patent defines that the means for engaging the foundation includes means for separately securing said support means thereto upon the latter engaging a load bearing underground strata. The current invention, on the other hand, releases it hydraulic means at that time, and replaces it with a jack and ratchet screw arrangement. Once the current invention attains contact with the bedrock, upon driving of its pipe sections downwardly into the ground, it is not necessary to shore up the foundation, as called for in the claims of this particular patent. One just removes the hydraulic means, before any final shoring occurs, and attains final shoring through the usage of its various ratchet screws and jacks, thereafter.

The patent to Breuchaud, U.S. Pat. No. 570,370 shows a construction of supports for walls. It utilizes a type of support for connection with a foundation wall, being the shown beam, and then utilizes a hydraulic jack for driving tubular columns into the earth until support is attained.

The patent to Gillespie, U.S. Pat. No. 598,418 shows a construction of supports for building walls, or the like, and once again utilizes hydraulic jacks for driving columns into the earth, with the hydraulic jacks cooperating with transverse beams or girders, that rest under the building wall, for providing support during installation of the columns.

The patent to Goldsborough, U.S. Pat. No. 1,063,869, shows another method for underpinning buildings. It utilizes hydraulic rams, arranged under the foundation wall and its footing, for driving the beams into the subsoil, and apparently down to bedrock.

The patent to White, U.S. Pat. No. 1,217,128 shows a method of providing substructures for buildings, and once again, it utilizes the hydraulic jack in cooperation with the blocking means that rest upon a cap which is provided upon the top of piles, for driving them down to bedrock.

The patent to Phelps, U.S. Pat. No. 1,279,901, discloses a form of house jack, which is this particular instance, is probably simply a jack means for use for raising the house, as when it is being moved, or for supporting a part of its foundation.

The patent to Gooder, U.S. Pat. No. 1,705,612, shows another method for underpinning of a building wall, through the use of its shown jack screws.

The patent to Lenahah, U.S. Pat. No. 2,322,855 shows another method and apparatus for raising and permanently supporting heavy structures. Once again, it utilizes the combination of its shown jack, which apparently is of the hydraulic type, in combination with a cap, that fits under a located lifting member, for use for raising the foundation wall, or what is identified as a pier, apparently through the driving of pipe sections into the ground.

The patent to Revesz, et al, U.S. Pat. No. 2,982,103, shows another method and apparatus for underpinning a building. It utilizes a device of the type that is apparently affixed to the side of the foundation wall, by attachment of a wall plate, and then utilizes a hydraulic jack in cooperation with a load plate that is attached to the wall bracket, urging the various pipe sections into the ground.

The patent to Heacox, U.S. Pat. No. 3,685,301, shows another complex process and apparatus for installation of jack piles.

The patent to Mahoney, U.S. Pat. No. 3,796,055, shows another method and apparatus for underpinning and raising a building. This particular patented structure is pertinent because it does show the usage of a form of bracket, which obviously slips under the foundation wall, and then utilizes a hydraulic cylinder apparently for driving pipe pile sections into the ground, through the usage of the clamp, and once that is achieved, the pipe sections are capped with a member, apparently concreted in place, and then a series of extendable support soldiers, and which appear to be in the form of ratchet screws, are located into position to support the foundation wall in preparation for its concreting in place.

The patent to Cassidy, U.S. Pat. No. 3,852,970, shows another form of building raising and underpinning system. The system of this disclosure is similar to the structure and functioning of the earlier patents defined, particularly the Revesz patented device. Once again, though, the structure of this device defines a building raising or underpinning structure that comprises a series of attaching wall plates.

Another patent to Cassidy, U.S. Pat. No. 4,070,867, shows further modification upon his particularly styled pile driven support for supporting a foundation wall.

The patent to David, U.S. Pat. No. 4,338,047 discloses a system for pier underpinning of a settling foundation. It utilizes the concept in combination with hydraulic rams, and jack screws for supporting a settling foundation. These are located underneath the foundation wall, and then cemented in place once formed.

The patent to Murray, et al, U.S. Pat. No. 4,507,069, shows an apparatus for positioning and stabilizing a concrete slab. This particular device is apparently extended directly through a concrete slab, to support it from settling, and is not necessarily used in combination with any type of footing or foundation wall.

Another patent to Langenbach, Jr., U.S. Pat. No. 4,563,110, shows a form of shoring apparatus and method. As can be seen, apparently this particular device is used for shoring concrete floors or slabs, and is quite different from the subject matter of this current invention.

A further patent to Murray, et al, U.S. Pat. No. 4,591,466, shows a method for positioning and stabilizing a concrete slab, which is related to the earlier U.S. Pat. No. 4,507,069.

The patent to May, U.S. Pat. No. 4,634,319, shows a method and apparatus for lifting and supporting structures, and includes a vertically positioned pier driven in the ground adjacent the building structure, and having an upper end proximal to the base of the building structure. A pier plate unit is fitted over the upper end of the driven pier. The pier plate unit acts in cooperation with a shoe attaching to the base of the building structure, with the shoe being implaced in overlying relationship to the pier plate unit. It then utilizes a temporary lifting means between the pier plate unit, and the shoe, for initially lifting the shoe and therefore the building structure. The current invention, to the contrary, simply utilizes a load bearing bracket which is removably placed around jack screws, and not a complex of structures in the category of pier plate units and shoes, as shown in this prior art.

The patent to Shaw, et al, U.S. Pat. No. 4,673,315, shows another apparatus for raising and supporting a building, and in this particular device, there is included specific structure in the form of a tubular guide means, with a pipe assembly extending through the guide means, in order to attain foundation or slab support.

The patent to Gregory U.S. Pat. No. 4,695,203, shows another method and apparatus for shoring a building foundation, and the apparatus as defined utilizes a form of tubular guide, having the pipe assembly section extending through it, to attain support for the foundation or slab.

The patent to Cox, U.S. Pat. No. 4,684,097, shows a type of stanchion for use in conjunction with the support of a mobile home.

The patent to Thorpe, U.S. Pat. No. 3,222,030, shows a floor structure elevating device.

The patent to Landers, U.S. Pat. No. 4,773,792, shows a system for stabilizing structural elements. This device, while showing lifting means, as for use in combination with a concrete wall, apparently is for use for raising and supporting a load bearing structural element through the usage of spacer screws.

Finally, the patent to May, U.S. Pat. No. 4,854,782, shows another type of apparatus for lifting structures. This device provides for the relative displacement between the shoe and a sleeve that is fitted over the upper end of the pier, and then temporarily lifts these two components with respect to each other, before adding a permanent supporting means therein.

In the systems of the prior art which bolt the pier driving bracket foundation wall to guide the piers into the ground, the pier pipes may be skewed. This results because the wall has settled and may not be in a proper position to guide the pier segment vertically into the ground.

SUMMARY OF THE INVENTION

One object of the present invention is to provide a pier assembly where significant pressure can easily be applied to the foundation bracket which will support the foundation.

Another object is to provide such a structure which relies on compression forces, rather than shear forces, to support the building.

Another object is to provide such an assembly wherein the piers are driven vertically into the ground.

Another object is provided such a pier assembly which allows for later lifting of the structure, should the building settle further.

A further object of this invention is to provide a pier assembly which locates directly underneath of the building foundation, at the position where it is to be supported, or slightly elevated, and then functions to drive support deeply into the ground, at said aligned position, to provide full and comprehensive support for the building foundation.

A further object of this invention is to utilize a pier driving unit that may be aligned directly beneath the foundation wall, subjected to hydraulic jacking, for its positioning, driving pier pipe segments into the ground, down to bedrock, or other support, to provide stabilization to the foundation wall and the building thereabove.

These and other objects will become more apparent to those skilled in the art in light of the following disclosure and accompanying drawings.

In accordance with the invention, generally stated, a pier driving assembly is provided which does not require the pier to support the building under shear stresses. The assembly includes a pier driving bracket which includes a hollow tube secured to a bottom plate. The tube includes an elongate slot. A pier driving shoe is slidably received in the tube. The shoe includes a pier pipe engaging portion which extends through the slot. A hydraulic ram is received through the top of the tube to be in contact with the shoe. The ram presses down on the shoe so that said pier engaging portion will press down on a pier to drive said pier into the ground.

The bracket further includes a flange which engages the underside of the foundation footing to secure the bracket assembly in an excavation. An upwardly extending hydraulic ram is mounted on the flange. The ram bears against the footing when activated to secure the bracket assembly in said excavation.

The bottom plate has a hole therein through which the pier is pushed by the shoe and ram. An alignment bar surrounds the hole to aid in aligning the pier as it is driven into the ground.

A foundation supporting assembly is provided to support the foundation after the pier has been driven into the ground. The foundation supporting assembly is placed on the pier to support said foundation after the pier driving bracket has been removed from the excavation. The foundation supporting assembly comprises a body which is placed around the pier and a threaded tube mounted on a plate which in turn, is mounted on the body. The bolt engages the underside of said foundation to support the foundation under compression. The body includes a semi-circular elongate plate having a cover covering the top thereof and a bolt receiving plate at the bottom thereof. The body is held against said pier by a U-bolt which surrounds the pier and is passed through the bolt receiving plate.

A loading bracket is used to give the foundation a final lift to level the foundation, or to stabilize it, after the pier has been driven to bedrock. The loading bracket is placed on the pier around the foundation support bracket. The loading bracket includes a body which is removably secured to the pier around the foundation supporting bracket and jacks mounted on the sides of the body. The body is generally U-shaped and has a pair of rear slots which interlock with a locking plate to hold the loading bracket in place around the pier.

A method of using the pier driving bracket, foundation supporting means, and loading bracket is also disclosed.

In a modification to the invention as described above, a pier driving unit is placed in an excavation directly beneath the foundation wall, and the unit is aligned and leveled in position. Hydraulic jacking cylinders are placed on reaction brackets, integrally formed of the pier driving unit, one each laterally of the said unit, and hydraulic pressure is applied to provide for stabilization of the driving unit in place. Following this, sections of a steel pier pipe are placed inside the pier driving bracket, and within the base frame slot, and a pair of hydraulic driving cylinders are activated causing the driving bracket to move downwardly, for urging the pipe sections deeply into the ground. Aligned segments of the pipe sections may be located in place, once the hydraulic driving cylinders are retracted, to continue the driving of the generally two foot segments of pier pipe into the ground, until such time as bedrock, or suitable stratum sustaining of pressure is encountered, sufficiently to support the foundation, and the segment of the building wall thereabove. At this stage, the pier pipe is brought up to an appropriate height, through the addition of two foot segments in place, and driven into the ground until suitable bearing stratum is reached, at which time the pier driving unit is removed, and the entire pier pipe is filled with concrete, to provide a stable and integrated pier. A pier head assembly is the placed on top of the pier pipe, held in place by means of a bolt means, the pier loading bracket is placed around the pier head, and locked in place. Two hydraulic jacking cylinders are then loaded, a permanent bearing plate is position between the cylinders and the bottom of the footing, hydraulic pressure is applied to achieve jacking of the cylinders to impose a structural load upon the pier pipe, if necessary, to raise the building, or at least stabilize it in place. A large diameter bolt threaded to the pier pipe is advanced upwardly as the hydraulic pressure is being applied, such that the bolt means will be elevated into position, to sustain the foundation in place, at which time the hydraulic cylinders are released, and the pier head large diameter bolt then sustains the load, and supports the structure, as desired and required. Then, the entire excavation can be backfilled to totally conceal the supporting and underpinning structure.

It will be seen upon reviewing the following disclosure and accompanying drawings that the described invention overcomes the deficiencies of the existing systems.

DESCRIPTION OF THE PREFERRED EMBODIMENT

Figure 1A:
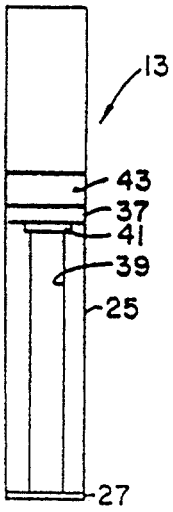
FIG. 1A is a view of a pier driving bracket of the present invention in an open position.
Figure 2:
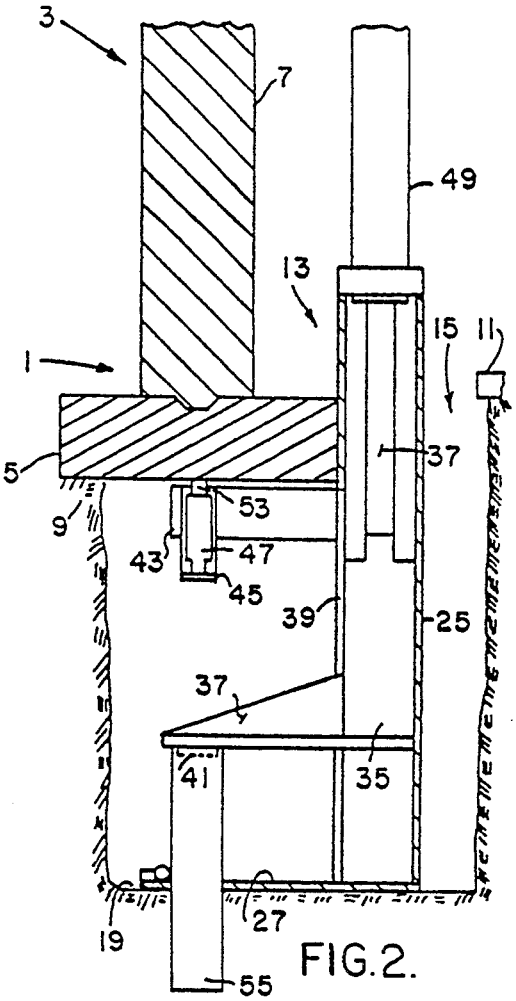
FIG. 2 is a partial cross-sectional view of the pier driving bracket positioned in an excavation for pier driving.
Figure 3:
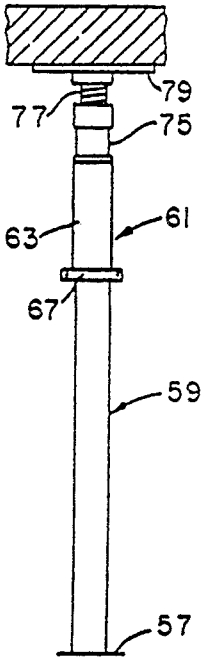
FIGS. 3 and 4 are front and side elevational views, respectively, of piers having pier heads thereon.
Figure 1B:
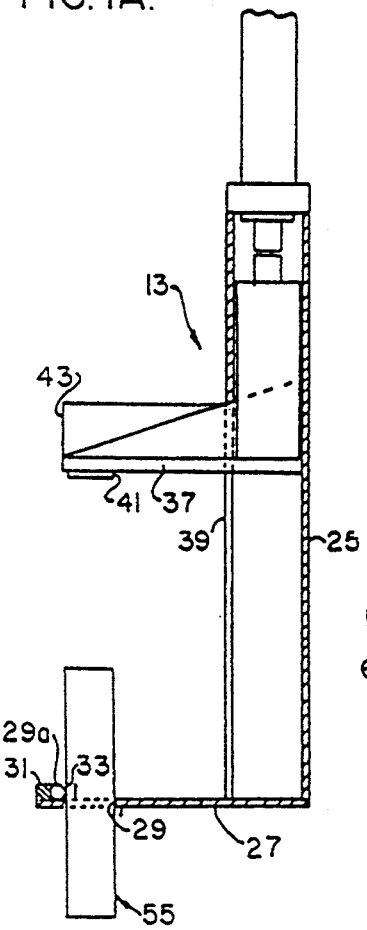
FIG. 1B is an elevational view of the pier driving bracket.
Figure 5:
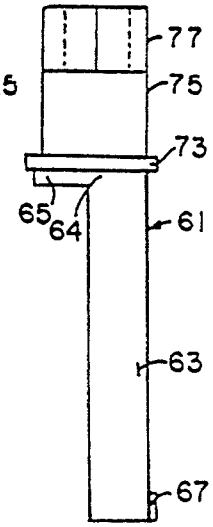
FIGS. 5 and 6 are side and front elevational views, respectively, of the pier heads, on an enlarged scale.
Figure 6:
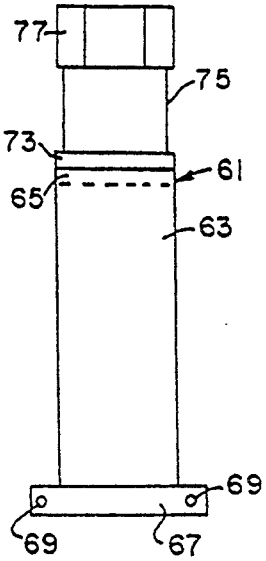

Referring to FIGS. 1 and 2, a foundation 1 of a building 3 is shown to include a poured concrete footing 5 and a basement wall 7 of poured concrete, cinder blocks, or the like. The footing 5 rests on prepared soil 9, such as a layer of clay, etc. As footing 5 is wider than basement wall 7, the footing distributes the load of the foundation wall over a larger area than the cross sectional area of the foundation wall. The building 3 also generally includes a basement floor 11 of poured concrete which covers the ground 9 and footing 5. If the prepared soil 9 is not strong enough to support the building, the building will settle, causing cracks on the foundation which may be repaired by underpinning the settled area of the foundation wall and raising it, or stabilizing it.

In accordance with this invention, an excavation 15 having a bottom 19 is dug near basement wall 7 to expose, and allow access to, the bottom of footing 5. A pier driving bracket 13 is positioned within excavation 15 adjacent footing 5. Excavation 15 may be made either inside or outside of building 3, however digging the excavation inside building 3 is generally easier, especially in a building with a basement.

Pier driving bracket 13 includes a hollow or tubular housing 25 having a bottom plate 27. Plate 27 defines an aperture 29*a* which is surrounded by an alignment bar 29*a*. A pair of retainers 31 and 33 define a channel in which alignment bar 29 rests. Housing 25 receives a pier driving shoe 35 therein having a triangularly shaped pier engaging portion 37. Pier engaging portion 37 extends through an elongate slot 39 in housing 25. Slot 39 defines a path along which portion 35 can slide between a raised position and a lowering pier driving position. Portion 37 includes a downwardly extending step 41 which is positioned above, and in axial alignment with aperture 29.

A foot supporting portion 43 extends fixedly, and outwardly from housing 25 above portion 35. Portion 43 includes bracket 45 which receives a hydraulic jack 47.

A hydraulic ram 49 having a piston 51 is received in housing 25 through the top thereof. Ram 49 is conventionally connected to the hydraulic power unit piston 51 and engages shoe 35 to push it down.

When bracket 13 is placed in excavation 15, plate 27 is placed on excavation floor 19 and the bracket 13 is manuevered so that it is adjacent footing 5. Note that the footing does not have to be broken away as required with usage of many of the prior art installations. Excavation 15 should be deep enough for portion 43 to slide under footing 5. To hold bracket 13 in place, hydraulic jack 47 is energized so that its piston 53 bears against the underside of footing 5. Hydraulic jack 47 will thus brace bracket 13 in place between footing 5 and excavation floor 19 by pushing it down solidly against excavation floor 19.

In operation a hollow pier pipe 55 is placed in plate hole 29 while the bracket is in an open position, as in FIG. 1. Shoe 35 is then brought down into engagement with pipe 55 by activating hydraulic ram 49. Step 41 is received within pipe 55. The engagement of pipe 55 with step 41 and with alignment bar 29 aids in properly aligning the pipe as it is driven into the ground. Further pressure is then applied by the hydraulic ram 45 to drive pipe 55 into the ground. Further pipe sections 55 are added to this first pipe section by using a coupling means of the type as known in the art. Pipe sections are added and driven into the ground until bedrock 57 or other weight bearing material is reached. Further pressure is then applied with ram 49 to verify that bedrock has been reached.

Figure 4:
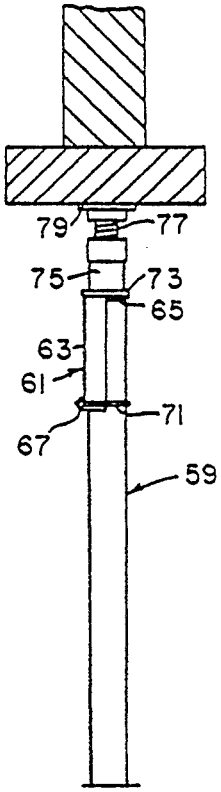
Figure 7:
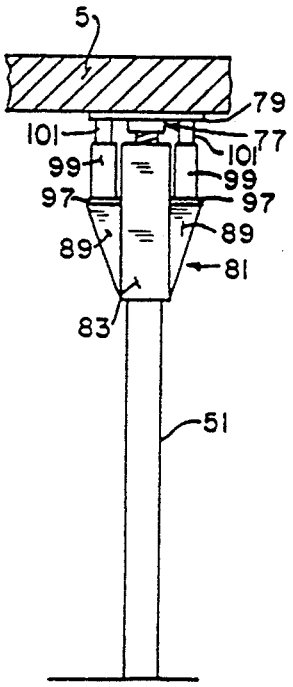
FIG. 7 is a front elevational view of a loading bracket positioned on the pier.
Figure 8:
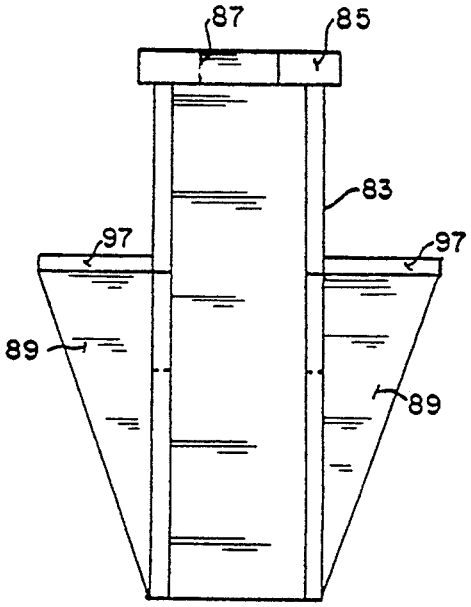
FIGS. 8 and 9 are front and side elevational views, respectively, of the loading bracket.
Figure 9:
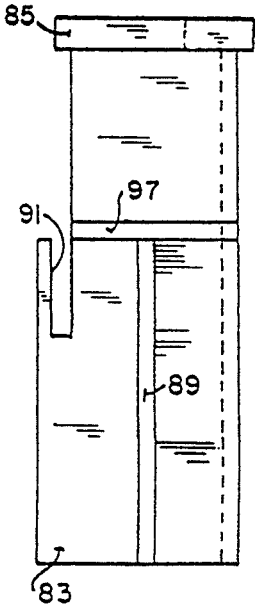
Figure 10:
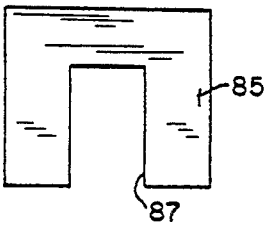
FIG. 10 is a top plan view of a cover plate of the loading bracket.
Figure 11:
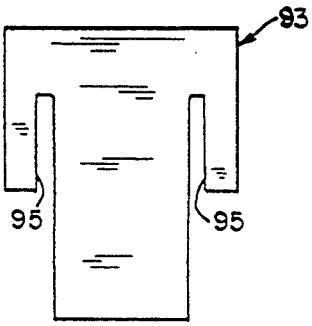
FIG. 11 is a front elevational view of a locking plate for use with the loading bracket.
Figure 12:
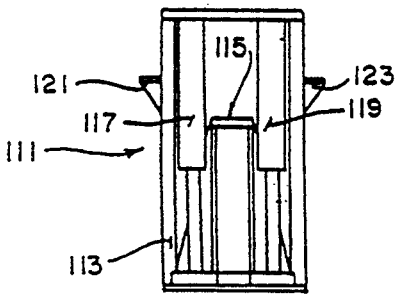
FIG. 12 is a front view of the pier driving unit, of the modification, placed in an excavation directly beneath the foundation wall.
Figure 13:
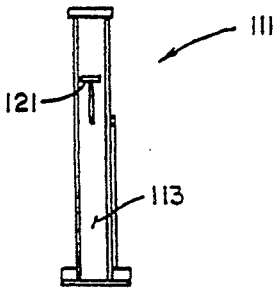
FIG. 13 is a side view of FIG. 12.

Pipe sections 55 form a hollow pier 59 which extends from the excavation 15 to bedrock 57. After the fact that bedrock has been reached is verified, the bracket 13 is placed in an open position, jack 47 is deactivated, and bracket 13 removed from excavation 15. The pier is then cut off an appropriate distance beneath footing 5 and filled with cement. A pier head 61 (FIGS. 3–6) is then placed on pier 59. Pier head 61 includes a semi-circular face plate 63 having a cover 64 with a rearwardly facing lip 65 and a bottom plate 67 with bolt holes 69. As seen in FIG. 4, the pier head 61 is placed on pier 59 with face plate 63 covering the side of pier 59 and cover 64 and lip 65 covering the top of pier 59. Thus, cover 64 and lip 65 support pier head 61 on pier 59. A U-shaped bolt 71 surrounds pier 59 and is passed through bolt holes 69 to hold pier head 61 against pier 59.

A rectangular plate 73 is placed on top of, and extends over cover 64 and lip 65. A short pipe 75 is secured to plate 73. Pipe 75 threadedly receives a heavy bolt 77. An elongate bearing plate 79 (FIGS. 3 and 4) is placed atop bolt 77. Bolt 77 is advanced until bearing plate 79 is tight against footing 5.

A loading bracket 81 (FIGS. 7–11) is then placed around pier head 61. Bracket 81 includes a squared off U-shaped body 83 which is capped with a cover plate 85 having a slot 87 therein. Slot 87 is sufficiently wide to fit around bolt 77 but narrower than pipe 75. Thus loading bracket rests on pipe 75 with plate 85 supporting the bracket.

Bracket 81 includes a pair of reinforcing gussets 89 extending from opposite sides thereof and a pair of rear slots 91. A flat locking plate 93 is received in slots 91. Plate 93 has a pair of slots 95 which correspond to bracket slot 91 so that the plate 93 may interlock with bracket 91 to hold it on pier 59, and prevent outward distortion of the bracket 81. Bracket slots 91 are exposed behind pier 59 and plate 93 is thus behind pier 59. Bracket 81 when locked in with locking plate 93 fully surrounds pier 59.

Gussets 89 include platforms 97 thereon which support hydraulic jacks 99 having pistons 101. Pistons 101 engage bearing plate 79 on opposite sides thereof. Jacks 99 are used to give a final lift to foundation 1 to properly level it, or to make a final forcing downwardly of the last and uppermost pipe section. When the foundation is properly leveled, bolt 77 is advanced so that it is, again, tight against bearing plate 79. Jacks 99 are then deactivated so that loading bracket 83 is removed. Excavation 15 can then be filled in or cemented in place.

This assembly allows for later modification of the pier 54 if it should settle further. To do so, excavation 15 is dug out, loading bracket 81 is mounted on pier 54 around pier head 61. Jacks 99 are activated to raise foundation 1. If this raise is sufficient to level the foundation, the bolt 77 may be advanced further. However, if further pier pieces 55 are needed, bolt 77 is loosened and pier head 61 is removed. Bracket 13 is then positioned in excavation 15 so that further pier pieces 55 may be driven into the ground. The foregoing procedure is then followed to properly raise foundation 1 so that it will again be level.

Figure 14:
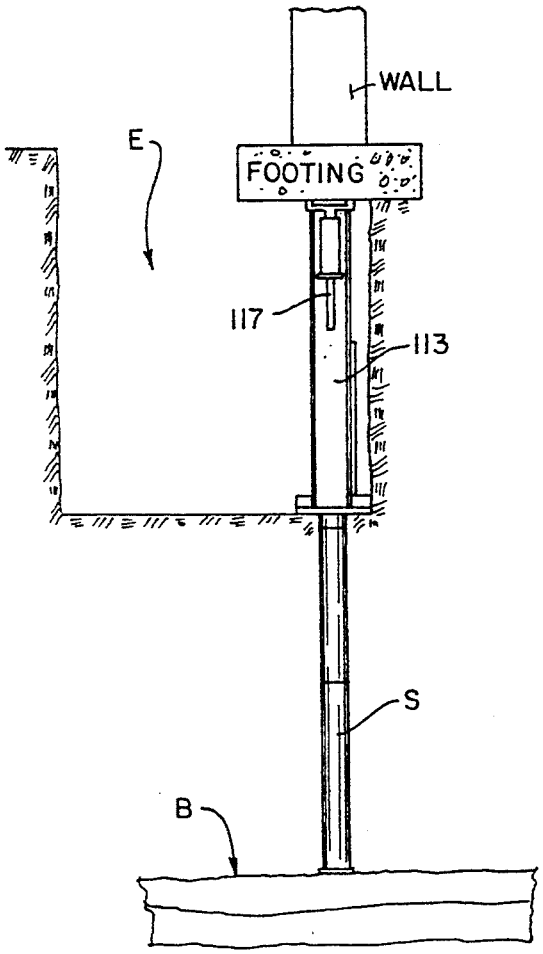
FIG. 14 provides a side view of the pier driving unit, and the various pipe sections driven to bedrock, as located within the excavation and aligned directly beneath the building wall and its foundation footing.

A modification to the invention, as previously summarized, is shown in FIGS. 12 through 20 of the drawings. As disclosed, in FIG. 12, in addition to FIG. 13, the pier driving unit 111, as disclosed, and includes a frame member 113, incorporating a pier driving bracket 115 therein, and a pair of hydraulic driving cylinders 117 and 119, where noted. Outwardly of the frame means 113 are a pair of platforms, generally identified as reaction brackets 121 and 123. When this structure is located in preparation for its usage and application, as can be seen in FIG. 14, the unit is arranged directly beneath the foundation footing, and the building wall, such that its frame means 113 is directly aligned thereunder, so as to provide full driving force of the pier pipe segments, as at S, directly into the ground, and down to bedrock, or suitable bearing stratum, as at B, where noted. As can be seen, the excavation E will have been made under a segment of the footing, where support is desired, so as to allow ease of access of the contractor for locating of the frame means, and to attain its functioning and operating, to obtain the desired results. As can clearly be seen in FIG. 14, the entire supporting structure, including the pier driving unit, is aligned directly under that segment of the footing, and the building wall, desired to be supported, or even slightly elevated. Thus, distortions or the type as encountered in the usage and application of prior art devices, is obviated.

Figure 15:
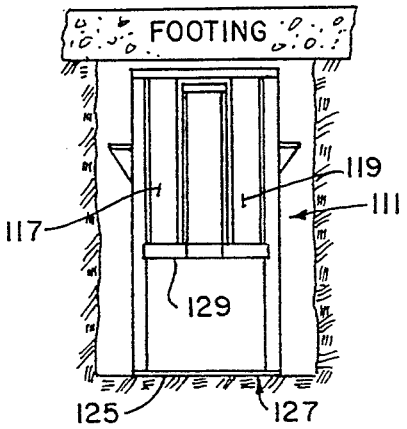
FIG. 15 is a front view of the pier driving unit as being located within an excavation beneath the footing.

FIG. 15 discloses the pier driving unit as located, in preparation for its usage. As can clearly be seen, the base plate 125 with its central slot 127 provided therethrough, is arranged for resting upon the bottom of the excavation, with the slot 127 providing clearance for insertion of the pipe segments therein, for their continuing driving into the ground, and forcing the pipe segments therebelow, down to bedrock, or otherwise, as previously explained, through the operations of the hydraulic driving cylinders 117 and 119, and their exertion upon the driving bracket 129, for driving the pipe segments deeply into the ground. (See also FIG. 20.)

Figure 16:
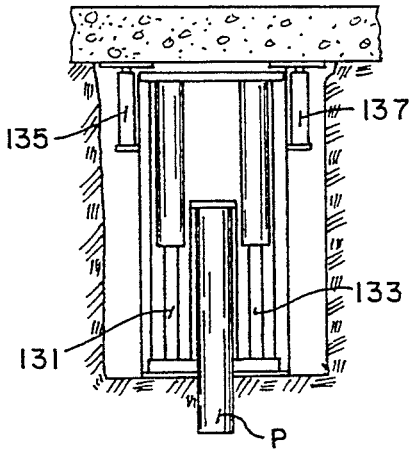
FIG. 16 is a front view of the pier driving unit of FIG. 15, with a pipe section being driven into the ground through operations of the pair of hydraulic driving cylinders.
Figure 20:
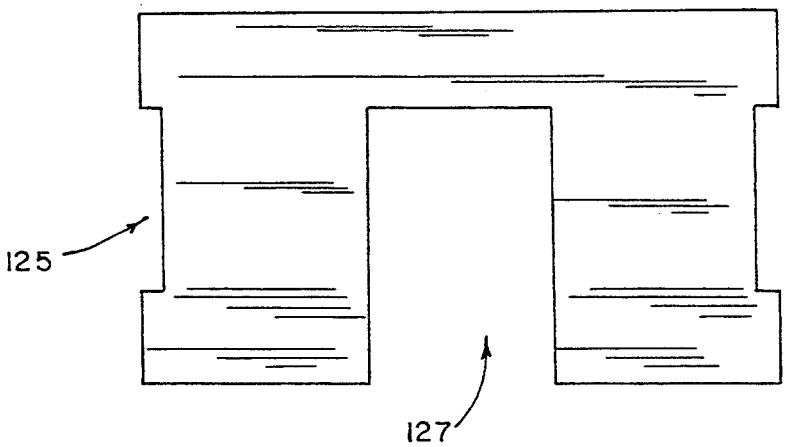
FIG. 20 is a plan view of the base plate of FIG. 15.

FIG. 16 discloses the pier driving unit in operation, showing a pipe segment P being driven downwardly, through the extensions of the rams 131 and 133, respectively, of the hydraulic driving cylinders 117 and 119. This operation continues, until such time as bedrock has been attained, or suitable bearing stratum has been reached, during operations of this modified device. It is to be noted, also, in FIG. 16, that before the driving of the pipe's segments is undertaken, a pair of hydraulic jacking cylinders 135 and 137 will have been located upon the reaction brackets 121 and 123, respectively, energized, for the purpose of stabilizing the pier driving unit 111 directly beneath the foundation footing, within the excavation, in preparation for these pipe segment driving functions.

Figure 17:
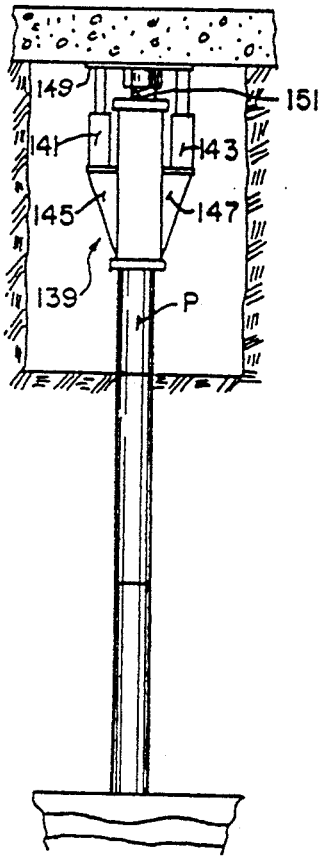
FIG. 17 discloses a pier head placed on top of the top pier pipe segment, after bedrock has been encountered, in preparation for the final lift and locating of the supporting bolt means.
Figure 18:
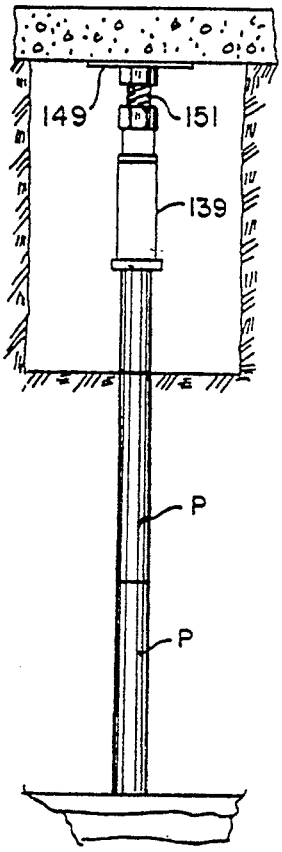
FIG. 18 is a view of the pier pipe segments, driven to bedrock, and supported by the pier head and the large diameter bolt head underneath the foundation footing.

FIG. 17 discloses that once the pipe segments have reached bedrock, or suitable bearing stratum, the pier driving unit is removed, and a pier head 139 is located upon the upper pipe segment B, and a pair of hydraulic jacking cylinders 141 and 143 are arranged upon the brackets 145 and 147, respectively, as noted. When energized, these jacking cylinders compress against the plate 149, for forcing the foundation footing upwardly, once again, into position for support of the building, and a large diametered bolt means, as at 151, is rested upon the pier head, is tightened into position beneath the plate 149, in order to fully support, through the various embedded pipe segments, the foundation wall. Once that is achieved, as can be seen in FIG. 18, the hydraulic jacking cylinders 141 and 143 may be removed, the building, and its foundation, is fully supported within the region of the excavation, to provide full support for the building at said location.

Figure 19:
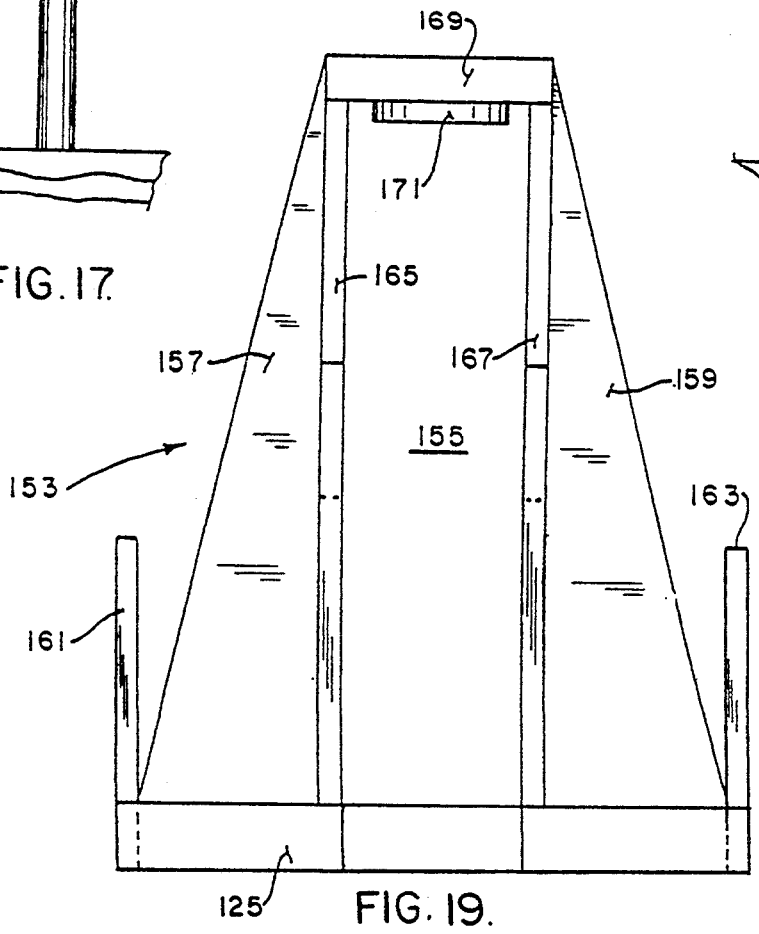
FIG. 19 is a front view of the pier driving bracket used in conjunction with the pier driving unit.

FIG. 19 provides a view of the pier driving bracket 153, that is used within the pier driving unit 111, when driving the various pipe segments P into the ground. It includes a back plate 155, with supporting gussets 157 and 159, side guides 161 and 163, which cooperate with the driving bracket 125, and has integrally provided upon the top of the side plates 165 and 167, the guide block 169, that partially fits, as at 171, within the next upper pipe segment, to position it, and locate it, in preparation for its driving into the ground. In the method of operation of this particular modified pier driving means, its procedure of usage and application is to locate the pier driving unit, within the excavation, directly beneath the foundation wall, with the unit being aligned and leveled at this position, as previously explained. The hydraulic jacking cylinders 135 and 137 are located, actuated, and position the unit in place. Then, the first pipe segment is located in position, within the slot 127 of the driving bracket 125, and is also positioned within, particularly its upper end, the pier pipe guide block 153, at which time the hydraulic driving cylinders 117 and 119 are located and energized, pushing their rams 131 and 133 downwardly, for pulling or pushing the guide block 153 downwardly, and compressing the next pipe segment into the ground. Once retracted, the next pipe segment may be located, and likewise driven into the ground, in the same manner. The hydraulic driving cylinders are continuously activated, for moving the driving bracket downwardly, for pushing a pipe segment into the ground, and then deactivated, for raising of the hydraulic rams 131 and 133, for insertion of the next pipe segment, until such time as either bedrock, or suitable bearing stratum, is attained. When that occurs, the hydraulic jacking cylinders 135 and 137 are deactivated, removed, and the pier driving unit is removed, and replaced by the pier head 139, in preparation for the locating of the bolt means 151, thereon, just subsequent to the positioning and energization of the jacking cylinders 141 and 143, at which time the bolt means 151 is extended, upwardly, and tightened under the foundation footing, against the plate 149, to fully stabilize the footing through the various pipe segments, and transmitting any compressive force generated thereon directly to bedrock, or bearing stratum, as explained. Concrete may have been inserted into the various pipe sections P. Thus, in FIG. 18, the finally located pipe segments P, arranged under the pier head 139, and fully supported by the bolt means 151, against the positioning plate 149, supports the foundation wall F, as noted, in position, and prevents further settling.

Numerous variations, within the scope of the appended claims, will be apparent to those skilled in the art in light of the foregoing description and accompanying drawings.

Having thus described the invention, what is claimed and desired to be secured by Letters Patent is:

1. A loading bracket for use with a foundation underpinning pier having foundation supporting means thereon, said loading bracket including a U-shaped body which is removably secured to said pier around said foundation supporting means and foundation raising means mounted to said body, said U-shaped body being inverted within the loading bracket during its application, said U-shaped body having a pair of laterally extending platforms formed thereon, said foundation supporting means and its platforms including jack means supported on said platforms and biasing against the underside of any foundation to be underpinned, said U-shaped body also including integrally formed rearwardly extending portions, each of which presents an upwardly disposed receiving slot, a locking plate, said locking plate having downwardly disposed slots, the locking plate interlocking by way of its slots within the upwardly extending slots of the U-shaped body to provide interlocking and prevent outward distortion of the loading bracket during actuation of the jack means for underpinning a foundation.

* * * * *